US006820695B2

(12) United States Patent
Stevens et al.

(10) Patent No.: US 6,820,695 B2
(45) Date of Patent: Nov. 23, 2004

(54) SNAP-LOCK SEAL FOR SEAL VALVE ASSEMBLY

(75) Inventors: Michael D. Stevens, Duncan, OK (US); Earl D. Webb, Wilson, OK (US); Aimee K. Greening, Duncan, OK (US)

(73) Assignee: Halliburton Energy Services, Inc., Duncan, OK (US)

( * ) Notice: Subject to any disclaimer, the term of this patent is extended or adjusted under 35 U.S.C. 154(b) by 37 days.

(21) Appl. No.: 10/194,820

(22) Filed: Jul. 11, 2002

(65) Prior Publication Data

US 2004/0007359 A1 Jan. 15, 2004

(51) Int. Cl.[7] ..... E21B 17/14; E21B 33/14; E21B 34/06

(52) U.S. Cl. ..... 166/327; 166/242.8

(58) Field of Search ..... 166/374, 386, 166/326, 327, 285, 177.4, 242.8

(56) References Cited

U.S. PATENT DOCUMENTS

| | | | | |
|---|---|---|---|---|
| 2,058,688 A | | 10/1936 | Halliburton | 166/318 |
| 2,117,318 A | | 5/1938 | Hanes | 116/325 |
| 2,204,340 A | | 6/1940 | Bradshaw | 166/193 |
| 2,352,744 A | | 7/1944 | Stoddard | 166/154 |
| 2,846,015 A | | 8/1958 | Pittman | 166/320 |
| 2,847,074 A | | 8/1958 | Maly et al. | 166/325 |
| 3,120,269 A | | 2/1964 | Evans et al. | 166/120 |
| 3,332,499 A | | 7/1967 | Harris et al. | 166/242.8 |
| 3,385,370 A | | 5/1968 | Knox et al. | 166/317 |
| 3,385,372 A | | 5/1968 | Knox | 166/325 |
| 3,409,078 A | | 11/1968 | Knox et al. | 166/374 |
| 3,730,267 A | | 5/1973 | Scott | 166/335 |
| 3,768,562 A | | 10/1973 | Baker | 166/289 |
| 3,776,250 A | | 12/1973 | Knox | 137/71 |
| 3,948,322 A | | 4/1976 | Baker | 166/289 |
| 4,250,966 A | | 2/1981 | Streich et al. | 166/242.8 |
| 4,338,999 A | | 7/1982 | Carter, Jr. | 166/117 |
| 4,413,682 A | | 11/1983 | Callihan et al. | 166/242.8 |
| 4,457,377 A | | 7/1984 | Burris, II | 166/332.4 |
| 4,624,316 A | * | 11/1986 | Baldridge et al. | 166/285 |
| 4,687,019 A | | 8/1987 | Mayfield | 137/375 |
| 4,712,619 A | | 12/1987 | Stepp et al. | 166/327 |
| 4,729,432 A | | 3/1988 | Helms | 166/317 |
| 5,113,900 A | * | 5/1992 | Gilbert | 137/515.5 |
| 5,379,835 A | | 1/1995 | Streich | 166/181 |
| 5,472,053 A | | 12/1995 | Sullaway et al. | 166/327 |

(List continued on next page.)

OTHER PUBLICATIONS

Halliburton Casing Sales Manual, Oct. 8, 1993, pp. 1–13 and 1–23.

Halliburton Services, "Floating Equipment" catalog (undated but admitted to be prior art).

SPE Paper 25440 entitled "Reverse Circulation Of Cement On Primary Jobs Increase Cement Column Height Across Weak Formation" by J. E. Griffith, D. Q. Nix and G. A. Boe, presented at the Production Operation Symposium held in Oklahoma City, Oklahoma, Mar. 21–23, 1993.

Journal of Petroleum Technology article titled "Primary Cementing By Reverse Circulation Solves Critical Problem In The North Hassi–Messaoud Field, Algeria" by R. Marquaire and J. Brisac, Feb., 1966, pp. 146–150.

Purchase Order No. 4501374200 issued Jun. 11, 2001.

Purchase Order No. 4501380766 issued Jun. 14, 2001.

*Primary Examiner*—David Bagnell
*Assistant Examiner*—Brian D. Halford
(74) *Attorney, Agent, or Firm*—John W. Wustenberg; Anthony L. Rahhal

(57) ABSTRACT

A float apparatus for use in a casing string. The float apparatus includes an outer case having a check valve positioned therein. A body portion which may be comprised of high compressive strength cement affixes the check valve to the outer case. The check valve includes a valve body and a valve element. The valve body defines a valve seat and the valve element is deformable so that it will conform to the shape of the valve seat and seal against flow in the casing.

13 Claims, 6 Drawing Sheets

U.S. PATENT DOCUMENTS

| | | | | |
|---|---|---|---|---|
| 5,494,107 | A | | 2/1996 | Bode ..... 116/285 |
| 5,647,434 | A | | 7/1997 | Sullaway et al. ..... 166/242.8 |
| 5,687,792 | A | | 11/1997 | Rodger et al. ..... 166/327 |
| 5,836,395 | A | | 11/1998 | Budde ..... 166/321 |
| 5,890,538 | A | | 4/1999 | Beirute et al. ..... 166/285 |
| 5,909,771 | A | * | 6/1999 | Giroux et al. ..... 166/242.8 |
| 6,244,342 | B1 | | 6/2001 | Sullaway et al. ..... 166/285 |
| 2003/0047314 | A1 | * | 3/2003 | Allamon ..... 166/242.8 |

* cited by examiner

SNAP-LOCK SEAL FOR SEAL VALVE ASSEMBLY

BACKGROUND OF THE INVENTION

This invention relates to floating equipment, or float apparatus, used in cementing operations and to methods of using such equipment. More particularly, this invention relates to an improved float apparatus that has a deformable valve element that will engage and seal against a valve body.

Typically, after a well for the production of oil and/or gas has been drilled, casing will be lowered into and cemented in the well. The weight of the casing, particularly with deep wells, creates a tremendous amount of stress and strain on the equipment used to lower the casing into the well. In order to minimize that stress, floating equipment, such as, but not limited to, float shoes and/or float collars, is used in the casing string.

The float equipment typically consists of a valve affixed to the outer casing which allows fluid to flow down through the casing but prevents flow in the opposite direction. Because upward flow is obstructed, a portion of the weight of the casing will float or ride on the well fluid thus reducing the amount of weight carried by the equipment lowering the casing into the well. Once the casing is in position, cement is flowed down through the inner diameter of the casing, through the valve and into the annular space between the outer diameter of the casing and the wellbore. After the cement job is complete, the valve keeps the cement below and behind the casing string.

The float equipment is typically fabricated by affixing a check valve in an outer sleeve which is adapted to be threaded directly into a casing string. The check valve generally includes a valve body and a poppet disposed in the valve body. The valve body defines a valve seat, and the valve poppet is urged into engagement with the valve seat to prevent flow through the valve body in one direction. An elastomeric seal, typically referred to as a lip seal, is generally positioned between the valve poppet and the valve body to provide sealing engagement. The present invention provides improved methods and apparatus for providing a seal in float apparatus.

SUMMARY OF THE INVENTION

The float apparatus of the present invention provides an efficient way in which to seal to prevent upward flow through the float apparatus. Float equipment, or float apparatus, as referred to herein may include any device referred to in the industry as float equipment or float apparatus, such as but not limited to float collars and float shoes. Generally, float apparatus includes an outer case, or outer sleeve with an outer surface and an inner surface. The inner surface of the outer sleeve defines a central opening, or flow passage. The check valve is disposed in the outer sleeve. The check valve includes a valve body, or valve housing which has an outer surface and an inner surface. The valve body defines a central opening communicated with the flow passage of the outer case. The valve body is fixedly attached to the outer case with a body portion. The body portion fills an annulus between the outer case and the valve body, and may be comprised of high compressive strength cement.

The float apparatus also includes a valve element that is sealingly engageable with the valve body. Preferably, the valve element is sealingly engageable with a valve seat defined on the valve body. The valve element is a deformable valve element that will conform to the shape of and thus seal against the valve seat defined by the valve body. Preferably, the valve seat has a first seat portion which may be cylindrically shaped, and a second seat portion that tapers radially inwardly from the first seat portion and may be frustoconically shaped. The valve element is connected to a valve stem which is movably disposed in a valve guide that is disposed in the valve body central opening and connected to the valve body. The valve element may be comprised of a thermoplastic material and is preferably comprised of a glass-filled NYLON. The valve element is more preferably comprised of a 33% glass-filled NYLON. The valve body likewise may be comprised of a thermoplastic material. The valve body is preferably comprised of a glass-filled NYLON and more preferably of a 33% glass-filled NYLON. The invention includes a biasing means that will urge the valve element into engagement with the valve seat by applying a force in a first, or upward, direction to move the valve element into engagement with the valve seat. Additional force in the upward direction causes the valve element to move from the first seat portion to the second seat portion and to seal against the second seat portion. The first direction referred to herein is the upward direction and the second direction is the downward direction. It will be understood that upward means toward the surface and that downward means toward the bottom or terminating end of the wellbore in which the float apparatus will be positioned.

DETAILED DESCRIPTION OF THE INVENTION

Figure 1:
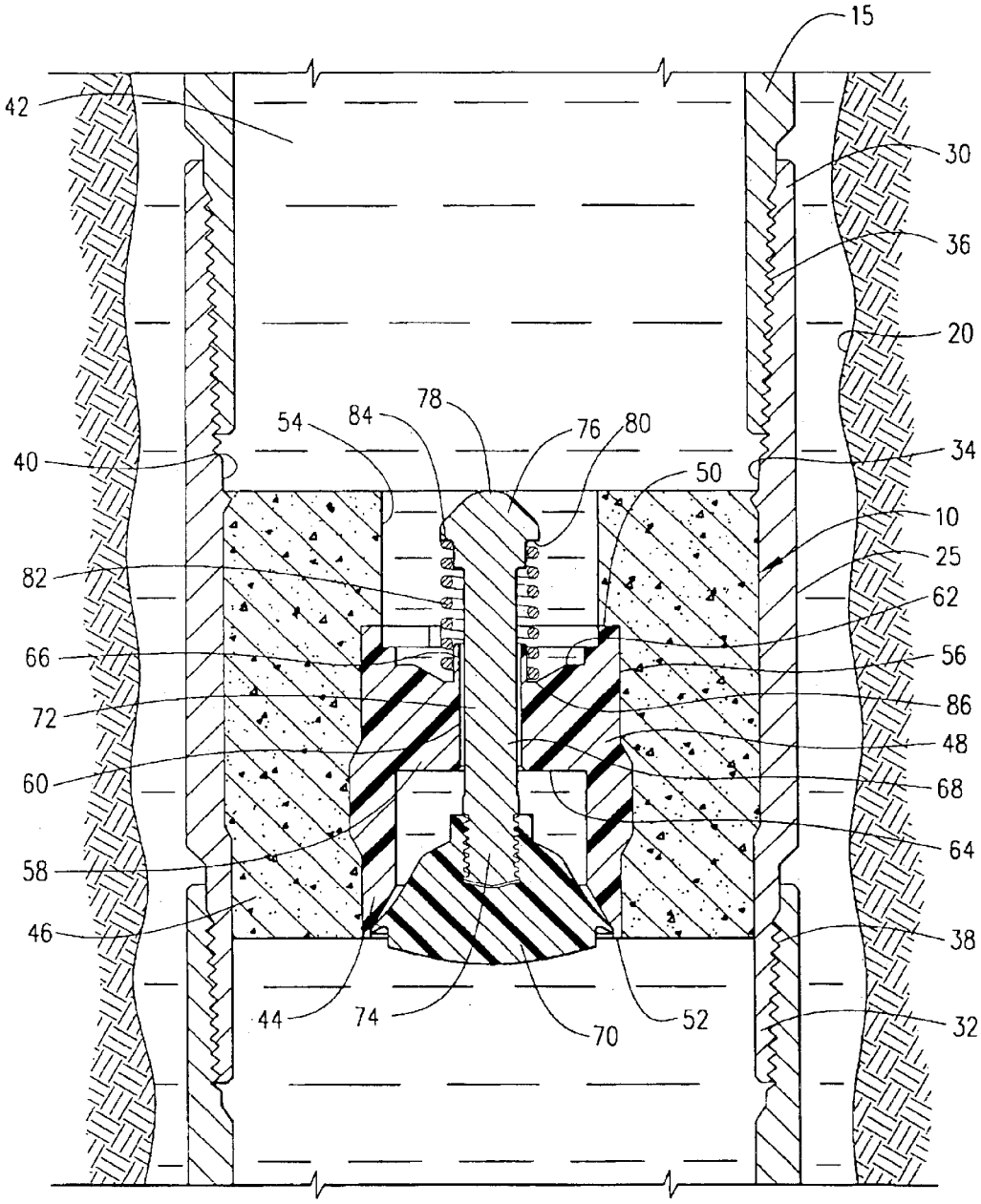
FIG. 1 is a cross-sectional view of the float apparatus of the present invention connected in a casing and lowered in a wellbore showing the valve element of the invention engaged with a first seat portion of a valve seat.
Figure 2:
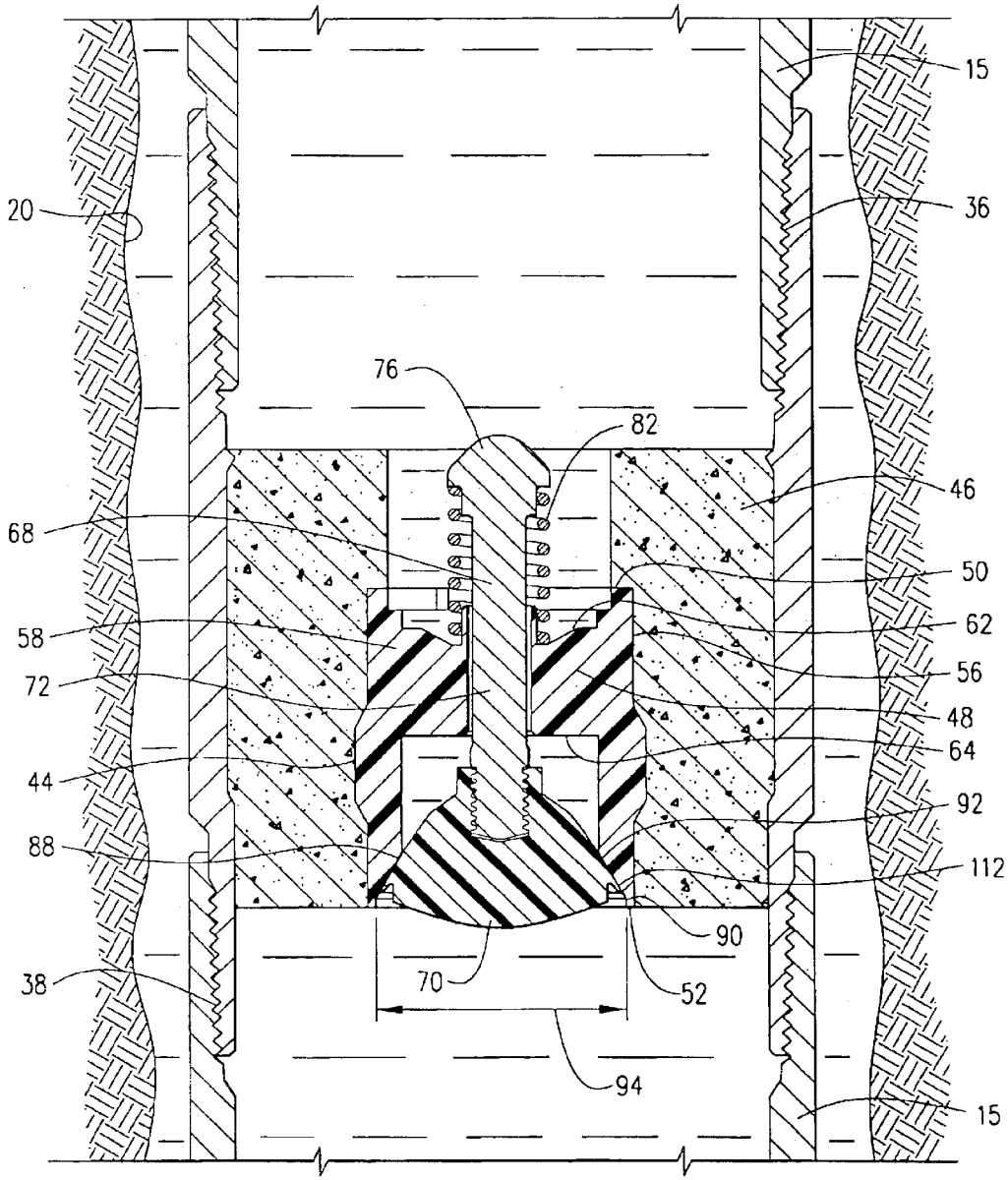
FIG. 2 is a cross-sectional view of the float apparatus of the present invention connected in a casing and lowered in a wellbore showing the valve element of the invention engaged with a second seat portion of a valve seat.

Referring now to the drawings and more particularly to FIG. 1, float apparatus 10 of the present invention is shown and described. Float apparatus 10 is shown connected in a casing 15 lowered into a wellbore 20. In FIG. 1, float apparatus 10 is shown as a float collar but may comprise any type of float apparatus known in the art, such as a float shoe. Float apparatus 10 has an outer sleeve or outer case 25 having an upper end 30, a lower end 32 and an inner surface 34. Float apparatus 10 is connected in casing 15 at its upper and lower ends 30 and 32 thereof with threaded connections 36 and 38 respectively. A flow passage 40 is defined by outer case 25. Flow passage 40 forms a part of a longitudinal central flow passage 42 defined by casing 15.

A check valve 44 is disposed in outer case 25. Check valve 44 is connected to outer case 25 and is preferably fixedly attached to outer case 25 with body portion 46. Body portion 46 is typically comprised of a cement, which will generally be a high compressive strength cement.

Figure 4:
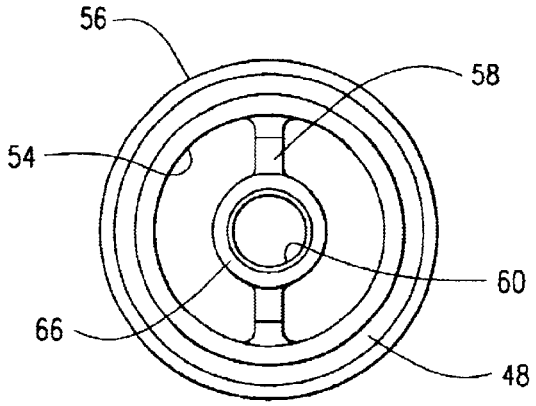
FIG. 4 is a view looking at the lower end of the valve body of the present invention.
Figure 5:
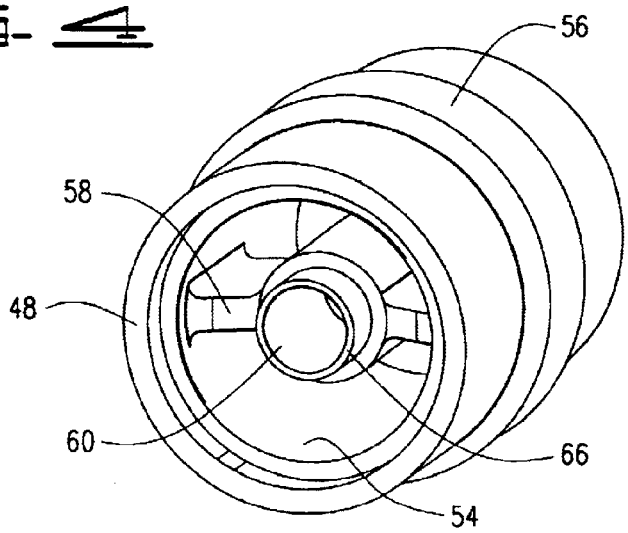
FIG. 5 is a perspective view of a portion of the valve body of the present invention.
Figure 6:
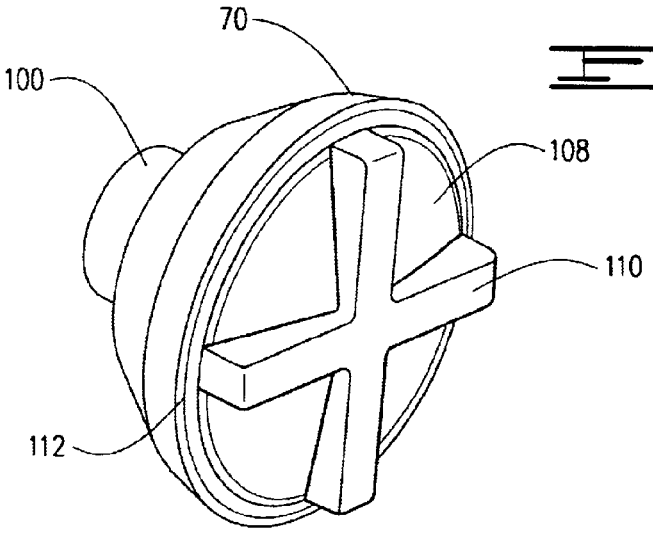
FIG. 6 is a perspective view of the valve element of the present invention.
Figure 7:
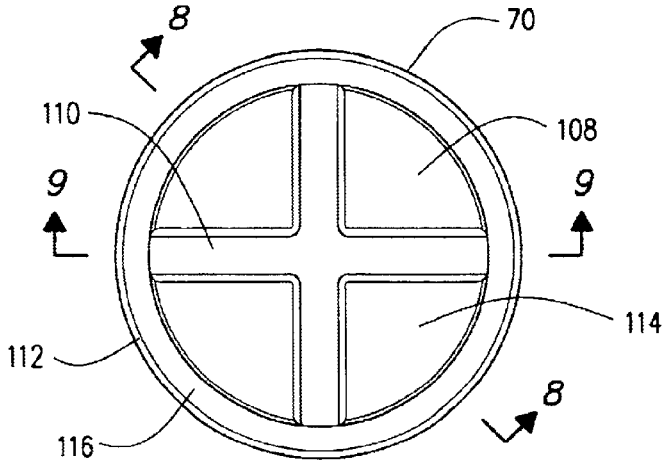
FIG. 7 is a bottom view of the valve element of the present invention.
Figure 8:
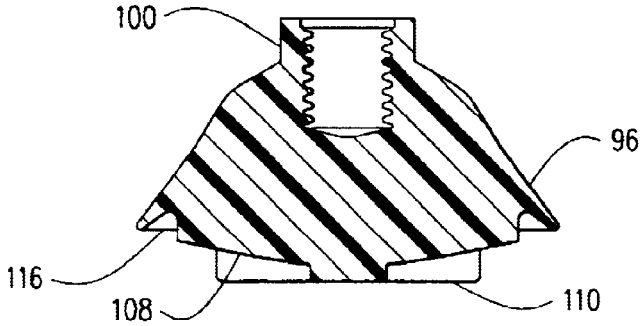
FIG. 8 is a view from line 8—8 of FIG. 7.

Check valve 44 comprises a valve body 48, which may be referred to as a valve housing 48, having an upper end 50, a lower end 52, an inner surface 54 and an outer surface 56. Inner surface 54 may also be referred to as a central opening 54. FIG. 4 shows a bottom view of the valve body 48. Valve body 48 includes a valve guide 58 which may be integrally formed with or connected to valve body 48. Valve guide 58 defines a generally cylindrical guide opening 60 and has an upper end 62 and a lower end 64. A sleeve portion 66 of valve guide 58 may extend above upper end 62 and define a portion of guide opening 60.

Check valve 44 may further include a valve poppet 68 which includes a valve element 70 and a valve stem 72. Valve stem 72 is connected at a lower end 74 thereof to valve element 70. Valve stem 72 is preferably threadedly connected to valve element 70 but may be connected by any means known in the art. Valve stem 72 has an enlarged head portion 76 at the upper end 78 thereof. Enlarged head portion 76 defines a shoulder 80. A spring 82 is disposed about valve stem 72. Spring 82 has an upper end 84 and a lower end 86. Spring 82 engages upper end 62 of valve guide 58 and engages shoulder 80. Spring 82 urges valve stem 72 upwardly so as to urge valve element 70 into engagement with a valve seat 88 defined on valve body 48.

Valve seat 88 may comprise a first seat portion 90 and a second seat portion 92. First seat portion 90 may be generally cylindrically shaped and has a diameter 94. Second seat portion 92 tapers radially inwardly from diameter 94 of first seat portion 90 and thus may generally be frustoconically shaped.

Figure 3:
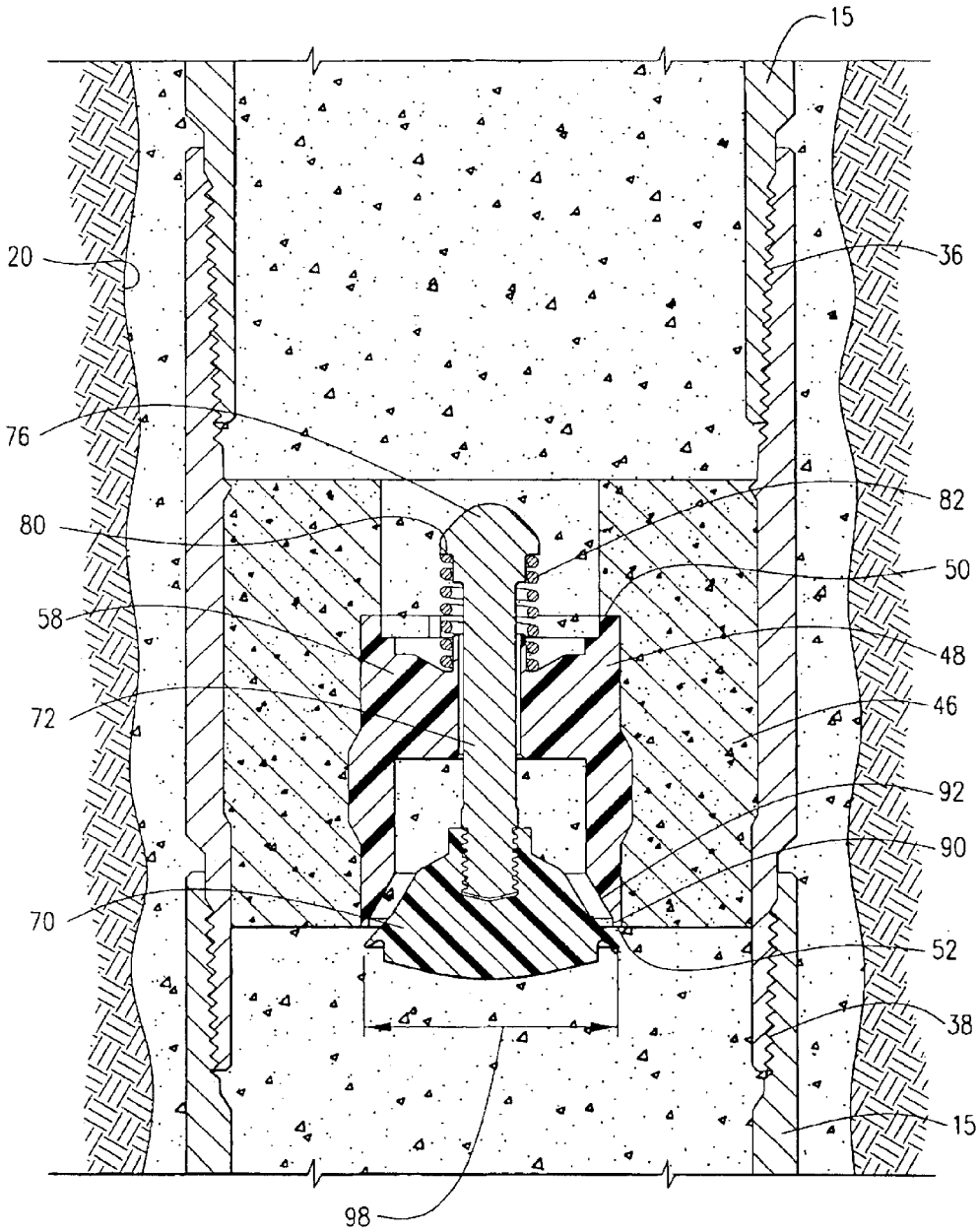
FIG. 3 shows the float apparatus of the present invention connected in a casing and lowered in a wellbore with the valve element disengaged from the valve body of the present invention.

Valve element 70 has an engagement portion 96. Engagement portion 96 is that portion of valve element 70 that will engage valve seat 88. Valve element 70 has an outer diameter 98 defined on the engagement portion 96 thereof. Outer diameter 98 is greater than diameter 94 of first seat portion 90. As can be better seen in FIG. 3 fluid, such as cement, may be disposed downwardly through casing 15, including float apparatus 10 at a sufficient rate to overcome the spring force of spring 82 to disengage valve element 70 from valve seat 88. Thus, as shown in FIG. 3, outer diameter 98 is in an unrestrained condition. Outer diameter 98 in the unrestrained condition of the valve element is greater than diameter 94 of valve seat 88. As shown in FIGS. 5–8, valve element 70 has a threaded receptacle portion 100 into which valve stem 72 is connected. A body 101 of valve element 70 tapers radially outwardly from receptacle portion 100 and has a first tapered portion 102 and a second tapered portion 104. A third tapered portion 106, which generally comprises the engagement portion 96 of valve element 70, tapers radially outwardly from second tapered portion 104. Valve element 70 has a generally arcuately shaped lower end 108 which may have support ribs 110 extending therefrom. Engagement portion 96 defines a flange 112. A central core 114 extends downwardly from flange 112. A space 116 is defined between flange 112 and central core 114. Central core 114 defines a diameter 118 that is smaller than outer diameter 98.

The operation of the invention is evident from the drawings. FIG. 1 shows float apparatus 10 as it is being lowered into wellbore 20. As shown therein, the force of spring 82 along with pressure in wellbore 20 is such that valve element 70 is urged upwardly so that it will initially snap into or be received in at least first seat portion 90. Valve element 70 may thus be referred to as a resilient or deformable valve element 70 that will conform to the shape of valve seat 88. As shown in FIG. 1, valve element 70 has conformed to the shape of first seat portion 90 so that it sealingly engages against first seat portion 90 to prevent flow in the upward direction through valve body 48 as float apparatus 10 is being lowered into wellbore 20 on casing 15.

Additional upward force applied to valve element 70, such as an increase in the pressure in the wellbore 20 will cause valve element 70 to move upward further so that it engages and seals against second seat portion 92. Thus, valve element 70 will further conform or deform to match the shape of second seat portion 92 to sealingly engage second seat portion 92 and prevent upward flow through valve body 48 as casing 15 is lowered into wellbore 20.

Valve element 70 may be made of any material known in the art that will deform and that can withstand the pressures and temperatures that will be seen in the wellbore. Valve element 70 may be comprised of a thermoplastic material and is preferably comprised of a glass-filled NYLON. Valve element 70 is more preferably comprised of a 33% glass-filled NYLON. Likewise, valve body 48 may be comprised of a thermoplastic material and is preferably comprised of a glass-filled NYLON. The most preferred material for valve body 48 is a 33% glass-filled NYLON.

FIG. 3 shows valve element 70 disengaged from valve body 48. Valve element 70 can be disengaged by flowing fluid through casing 15 and check valve 44 at a rate sufficient to overcome the spring force applied by spring 82 and the pressure in wellbore 20. Thus, fluid, such as cement for example can be circulated through casing 15 and check valve 44 when casing 15 reaches a desired point in wellbore 20 to cement casing 15 therein. Thus, the present invention includes a method for sealing against flow in the upward direction when casing 15 is being lowered into wellbore 20 by connecting check valve 44 in the casing 15 and by deforming a valve element 70 so that it will snap into and be conformed to the shape of valve body 48 to seal against upward flow. The method may further comprise continuing to urge valve element 70 upwardly so that it conforms first to the shape of first seat portion 90 and then to the shape of second seat portion 92 upon increased pressure in the wellbore 20 to sealingly engage the second seat portion of valve seat 88 defined in valve body 48.

Float apparatus 10 thus provides a method for creating a seal against flow by directly contacting the valve element with the valve body. This was not possible with prior art float apparatus which required a rubber or elastomeric component on the valve element, commonly referred to as a lip seal, to acquire the proper seal against flow.

Figure 9:
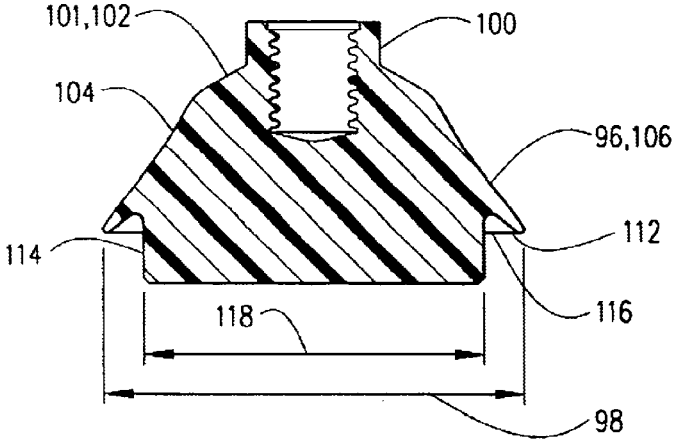
FIG. 9 is a view from line 9—9 of FIG. 7.
Figure 10:
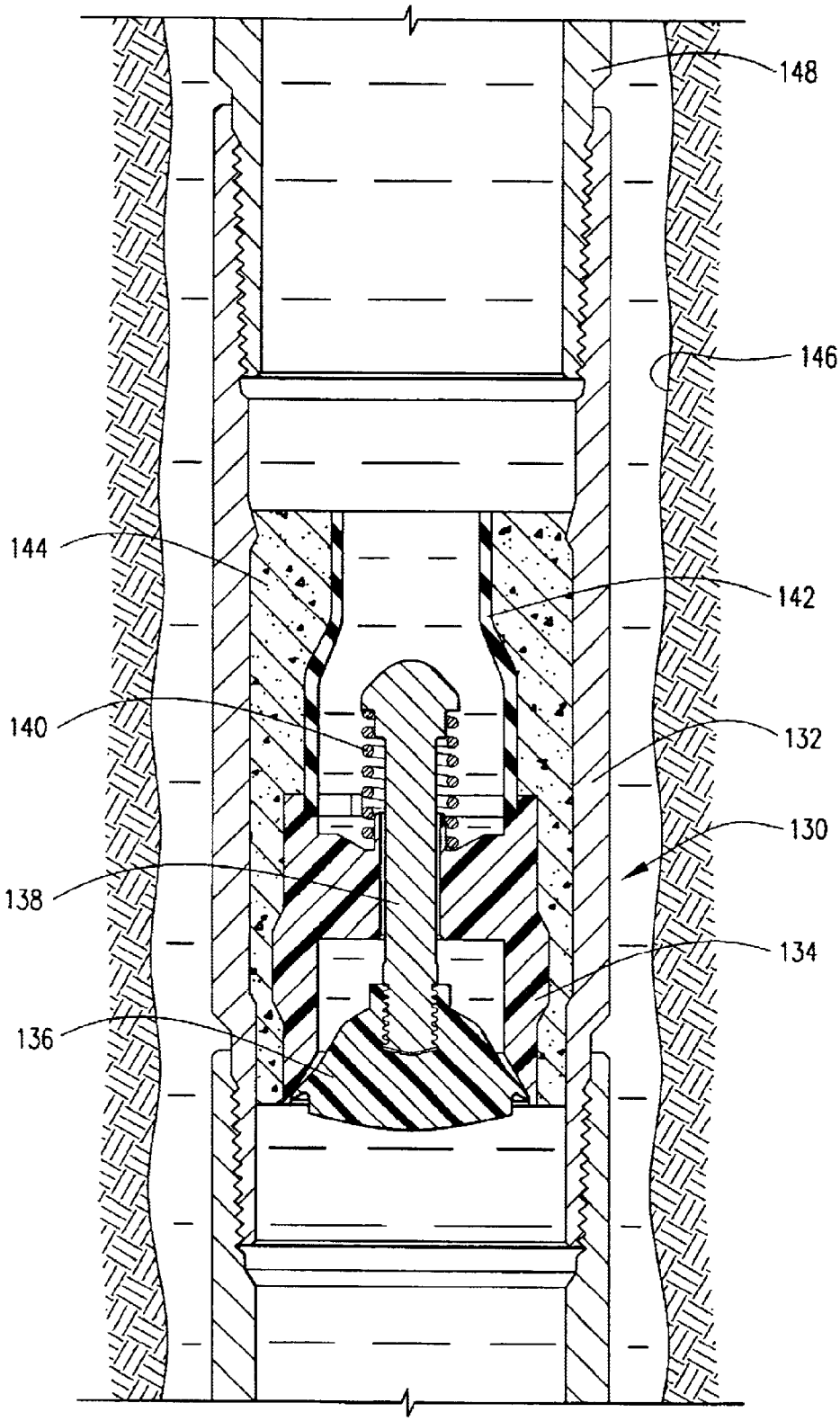
FIG. 10 is a cross-sectional view of an additional embodiment of the float apparatus of the present invention.

An additional embodiment of the float apparatus, which may be referred to as float apparatus 130 is shown in FIG. 9. Float apparatus 130 is generally identical to float apparatus 10 in that float apparatus 130 includes an outer sleeve or outer case 132, a valve body 134 that is generally identical to valve body 48 and a valve element 136 that is generally identical to valve element 70. Likewise, apparatus 130 includes a valve stem 138 and a spring 140. Valve stem 138 and spring 140 are generally identical to valve stem 72 and spring 82. Float apparatus 130 includes an upper valve body extension 142. Upper valve body extension 142 and valve body 134 are affixed to outer sleeve 132 with body portion 144 which is preferably a high compressive strength cement. The operation of float apparatus 130 is identical to that described herein with respect to float apparatus 10. Float apparatus 130 is shown being lowered into a wellbore 146 on a casing 148.

The foregoing descriptions of specific embodiments of the present invention have been presented for purposes of illustration and description. They are not intended to be exhaustive or to limit the invention to the precise forms disclosed and obviously many modifications and variations are possible in light of the above teaching. The embodiments were chosen and described in order to best explain the principles of the invention and its practical application, and thereby enable others skilled in the art to best utilize the invention and various embodiments with various modifications that are suited to the particular use contemplated. It is intended that the scope of the invention be defined the claims appended hereto and their equivalents.

We claim:

1. A float apparatus for use with a well casing comprising: an outer case;

a valve body connected to the outer case, the valve body defining a valve seat; and a deformable valve element sealingly engageable with the valve seat to prevent flow in a first direction through the valve body, the deformable valve element being disengageable from the valve seat to allow flow in a second direction through the valve body, the valve seat comprising a generally cylindrically shaped first seat portion and a generally frustoconically shaped second seat portion, wherein the deformable valve element engages the first seat portion upon an initial application of force in the first direction, and wherein the valve element will move in the first direction to the second seat portion upon an increase of applied force in the first direction.

2. The float apparatus of claim 1 wherein the valve body is connected to the outer case with a cement connecting body.

3. The float apparatus of claim 1 wherein the valve element is comprised of a thermoplastic material.

4. The float apparatus of claim 3 wherein the valve element is comprised of glass-filled NYLON.

5. The float apparatus of claim 1, the valve body defining a central opening for fluid flow therethrough, the float apparatus further comprising:

a valve guide disposed in the central opening; and a valve stem connected to the valve element and movably disposed in the valve guide.

6. The float apparatus of claim 1, wherein the second seat portion tapers radially inwardly from the first seat portion.

7. The float apparatus of claim 1, wherein the valve element is conformable to the shape of the second seat portion.

8. A float apparatus for use with a well casing comprising: an outer case;

a valve body connected to the outer case, the valve body defining a valve seat; and a deformable valve element sealingly engageable with the valve seat to prevent flow in a first direction through the valve body, the deformable valve element being disengageable from the valve seat to allow flow in a second direction through the valve body, the valve seat comprising a first seat portion and a second seat portion, the second seat portion tapering radially inwardly from the first seat portion, wherein the deformable valve element engages the first seat portion upon an initial application of force in the first direction, and wherein the valve element will move in the first direction to the second seat portion upon an increase of applied force in the first direction.

9. The float apparatus of claim 8 wherein the valve body is connected to the outer case with a cement connecting body.

10. The float apparatus of claim 8 wherein the valve element is comprised of a thermoplastic material.

11. The float apparatus of claim 10 wherein the valve element is comprised of glass-filled nylon.

12. The float apparatus of claim 8, the valve body defining a central opening for fluid flow therethrough, the float apparatus further comprising:

a valve guide disposed in the central opening; and a valve stem connected to the valve element and movably disposed in the valve guide.

13. The float apparatus of claim 8, wherein the valve element is conformable to the shape of the second seat portion.

* * * * *